US008136584B2

(12) United States Patent
Burnett et al.

(10) Patent No.: US 8,136,584 B2
(45) Date of Patent: Mar. 20, 2012

(54) SINGLE TRIP TUBING PUNCH AND SETTING TOOL

(75) Inventors: William Stephen Burnett, Aberdeen (GB); Irvine Cardno Brown, Aberdeen (GB)

(73) Assignee: Red Spider Technology Limited, Westhill, Aberdeenshire (GB)

( * ) Notice: Subject to any disclaimer, the term of this patent is extended or adjusted under 35 U.S.C. 154(b) by 558 days.

(21) Appl. No.: 12/322,129

(22) Filed: Jan. 29, 2009

(65) Prior Publication Data

US 2009/0194277 A1 Aug. 6, 2009

(30) Foreign Application Priority Data

Jan. 31, 2008 (GB) ..... 0801730.3

(51) Int. Cl.
*E21B 43/11* (2006.01)

(52) U.S. Cl. ..... 166/55.1; 166/297; 166/298; 166/255.1

(58) Field of Classification Search ..... 166/255.1, 166/55.1, 297, 298
See application file for complete search history.

(56) References Cited

U.S. PATENT DOCUMENTS

| | | | | |
|---|---|---|---|---|
| 2,355,513 | A * | 8/1944 | Cox | 114/334 |
| 2,381,929 | A * | 8/1945 | Schlumberger | 166/55.1 |
| 5,183,111 | A | 2/1993 | Schellstede | |
| 6,142,231 | A | 11/2000 | Myers, Jr. et al. | |
| 7,575,062 | B2 * | 8/2009 | East, Jr. | 166/386 |
| 2003/0051876 | A1 * | 3/2003 | Tolman et al. | 166/313 |
| 2006/0231258 | A1 | 10/2006 | Head et al. | |
| 2007/0181303 | A1 | 8/2007 | Billingham et al. | |

OTHER PUBLICATIONS

United Kingdom Search Report dated Apr. 29, 2009.
Extract from Baker Oil Tools' Catalogue, p. 669, showing a seal bore packer system.

* cited by examiner

*Primary Examiner* — Daniel P Stephenson
*Assistant Examiner* — Yong-Suk Ro
(74) *Attorney, Agent, or Firm* — Ladas & Parry LLP

(57) ABSTRACT

A tubing punch and setting tool (TPST), operating on a single run for improved well bore intervention. The tool includes a setting tool for connecting to and setting a reference tool in a tubing string, a punch tool for punching holes in the tubing string wall, and actuation means to trigger the sequencing of the setting tool and the punch tool. The tool can be run on wireline, e-line or coiled tubing and allows a reference tool to be run and set on the same trip as punching holes in the tubing string. The reference tool can be an anchor tool. With the distance known accurately between the anchor tool and the punched holes, a shortened retrofit gas lift straddle can be deployed.

20 Claims, 3 Drawing Sheets

SINGLE TRIP TUBING PUNCH AND SETTING TOOL

BACKGROUND OF THE INVENTION

1. Field of the Invention

The present invention generally relates to well intervention and more particularly to a single trip system for the placement of a bridge plug, packer or anchoring mechanism in the wellbore and for punching communication holes through the production tubing.

2. Background of the Related Art

Currently, when communication is required through the production tubing, and a sliding sleeve arrangement cannot be used, a tubing puncher is run into the desired depth. A tubing puncher is a tool which typically has a mechanical punch driven by a jarring tool or hydraulic ram. The penetration is controlled so that it punches holes in the inner tubing string without damaging the outer casing or well bore formation. This is in contrast to perforating guns. Perforating guns use an explosive charge to blast through the tubing, typically to access the formation. Their action is not controlled as the hole produced does not have defined dimensions as for a punched hole. By punching holes through the tubing string controlled circulation is achieved between the tubing and the annulus. Once the holes are punched, the tubing puncher is then retrieved from the well.

During well intervention or a work over, such hole punching requires a dedicated separate trip into the well which is both time consuming and costly. The tubing puncher trip follows the trip to install bridge plugs or packers below the desired punched hole position. Further trips are then required to provide pressure isolation or to install intervention tools such as a gas lift straddle.

A further disadvantage in this multiple run approach is in the associated inaccuracy of wireline to record the precise depth location at which the holes have been punched. As a result any tool intended to locate below the punched hole has to be run deeper into the well to ensure that it is not located over or above the punched holes. This increases the tool string length, increasing the time and cost of intervention. For tools designed to locate across the punched holes, such as a gas lift straddle, these tools must be made at great lengths to ensure the packer elements set on either side of the holes. Typical lengths can be 20 to 30 ft between packing elements. The increased tool length makes handling on the rig difficult, while the increased weight provides a greater risk of breaking the wireline during run-in.

SUMMARY OF THE INVENTION

It is therefore an object of at least one embodiment of the present invention to provide a method and apparatus for running and setting a tool in a tubing string in the same trip as punching at least one hole in the tubing string.

It is a further object of at least an embodiment of the present invention to provide a tubing punch and setting tool for running and setting a reference tool in a tubing string and for punching at least one hole in the tubing string at a known location above the reference tool on a single trip.

It is a further object of at least one embodiment of the present invention to provide a tubing punch and setting tool which can be pre-programmed so that no signaling is required from surface to operate.

It is a yet further object of at least one embodiment of the present invention to provide a tubing punch and setting tool which can be run on wireline or electric line (e-line).

It is also an object of the present invention to provide a method of setting a tool and punching at least one hole in a tubing string on a single trip wherein the set tool acts as a reference point to accurately determine the position of the punched hole(s).

It is a further object of at least one embodiment of the present invention to provide a method of retrofitting a gas lift straddle.

According to a first aspect of the present invention there is provided a tubing punch and setting tool (TPST) for running and setting a reference tool in a tubing string in a well bore and for punching at least one hole in the tubing string on a single trip in the well bore, the TPST comprising: a substantially cylindrical body having a first end adapted for connection to conveyancing means; a setting tool with means to connect to the reference tool at a second end; a punch tool; at least one power delivery module; and, an actuation means located between the ends; wherein the actuation means triggers the power delivery module to power the setting tool to set the reference tool against the tubing and triggers the power delivery module to power the punch tool to punch at least one hole in the tubing.

In this way, the TPST provides for a reference tool to be run and set in a wellbore on the same trip as providing a punched hole through the tubing string for communication.

Preferably, the actuation means first triggers the power delivery module to power the setting tool to set the reference tool against the tubing and thereafter triggers the power delivery module to power the punch tool to punch at least one hole in the tubing. In this way, the distance between the punched holes and the reference tool can be accurately determined.

Preferably, the TPST includes detachment means to release from the reference tool and return to surface. The TPST may detach before or after the hole punch tool has operated.

Preferably, the setting tool is of the type which transmits a compressive force to set a tool.

In this way, the TPST provides a reference point in the tubing string at the reference tool from which the position of the punched hole(s) is accurately distanced from. When the TPST is pulled from the tubing, any other tools can be accurately sized such that when they are run in the tubing and landed on the reference tool, the punched holes are located at known positions in relation to these other tools.

Preferably the conveyancing means is wireline, e-line or coiled tubing. The use of a non-rigid conveyancing means for fast deployment and reduced running costs.

Preferably, a first power delivery module is located adjacent the setting tool and a second power delivery module is located adjacent the punch tool. Alternatively, one power delivery module can be used to operate both tools. By locating a single power delivery module between the setting tool and the punch tool, a relatively short distance can be achieved between the reference tool and the punched holes.

Preferably the punch tool comprises a substantially cylindrical body including at least two punch assemblies arranged perpendicularly to a central axis of the body, a hydraulic fluid chamber including a boost piston to compress the fluid and a fluid pathway, from the chamber, to deliver the compressed fluid to the punch assemblies and thereby operate the punch assemblies. Advantageously, the boost piston is powered from the second power delivery module.

Preferably each assembly comprises a cylindrical recess on an outer surface of the body; a piston arranged in the recess to provide a moveable seal between a lower end of the recess and an upper end of the recess, and a punch formed from a stem; elastic means located around the stem of the piston and abutted at a first end by a base of the piston and a second end by a piston cap arranged around the stem; and a shearing means to release the cap from engagement to the recess when sufficient hydraulic fluid pressure has entered the lower end of the recess and acted on the base of the piston.

In this way, hydraulic pressure drives the punch from the recess to punch a hole in the tubing. The elastic means may be a spring, elastomer or the like.

Advantageously, the punch tool includes a vent to allow for the exit of hydraulic fluid in the flow path from the tool at a predetermined pressure. Preferably the predetermined pressure is selected to be greater than the pressure required to punch the holes in the tubing. In this way, the vent can be used to release the punches and allow them to be retracted into the recesses.

Preferably, the punch tool includes emergency release means in the event that the punch tool becomes stuck. The emergency release means may comprise a shaped stem on the punch piston, the shape providing a weak point at an end of the stem. The shape may be formed from a relieved groove around the stem. By creating a weak point on the end of the stem, if the stem becomes stuck in the tubing wall, pulling on the punch tool will provide a transverse force sufficient to break the end of the stem and allow release of the tool. Preferably the shaped stem comprises a hole drilled into the distal end of the stem. In this way, when the stem is broken on release, the sheared stub left in the tubing provides a hole so that communication is established through the tubing to allow loss of hydraulic pressure or provide circulation.

Alternatively, or additionally, the emergency release means may comprise a mechanical release to separate the TPST at a location above the punch assemblies and allow the wireline carrying the TPST to be pulled out of the hole. Preferably, the mechanical release is by jarring down on the tool to desupport a collet and allow it to release. Advantageously the collet is protected by a sleeve on run-in so that the tool can be jarred without releasing the collet. Preferably the sleeve is moved when the punch tool is operated. Advantageously, a fishing neck is mounted within the punch tool which is left exposed following emergency release.

Preferably, the actuation means comprises an electronic processor, the processor being programmed to trigger and sequence the setting of the reference tool and the punching of the holes. The actuation means may also comprise one or more sensors. The TPST can thus be pre-programmed to operate on a timer or by reaction to conditions monitored by the sensor(s).

In this way, the holes cannot be punched until the reference tool is set to ensure the relative distance between each is known. The sensors advantageously allow the actuation sensor to be pre-programmed and operate remotely and independently from the surface.

Preferably, the power delivery module(s) comprise energy storage means, a separator piston and a hydraulic power transmission assembly. Such arrangements are as known in the art and may take the form of a pyrotechnic charge with electronic lighter, a differential atmospheric chamber, mechanical ball screw mechanism or a hydraulic pump.

Preferably the reference tool is an anchor. More preferably the reference tool is a packer or bridge plug. In this way, the reference tool is fixed in the well bore and can be used as a datum point to locate the exact relative position of the punched holes.

Preferably, the anchor is adapted to latch to the setting tool and a gas lift straddle wherein a first length from a latching end of the setting tool to a punch of the punch tool is approximately equal to a second length from a latching end of the straddle to a point midway between packer elements of the straddle.

In this way, the straddle is advantageously kept relatively short, with a typical distance between the packer elements of two feet rather than twenty feet in the prior art.

Preferably, the gas lift straddle comprises a tubular body having a through bore, first and second packer elements at first and second ends of the body, at least one port located through the body between the packer elements, and a gas head located on the body, the gas head having an inlet through which fluid from the port enters a check valve to ensure the fluid can only travel from the port to the bore.

Preferably, the gas head is releasably attached to the body of the straddle.

According to a second aspect of the present invention there is provided a single trip well intervention method, comprising;

(a) locating a reference tool on a setting tool of a TPST according to the first aspect;

(b) running the TPST into a tubing string until the punch tool is at a desired depth to locate a punched hole through the tubing;

(c) triggering a power delivery module to set the reference tool against a wall of the tubing using the setting tool; and (d) triggering a power delivery module to punch at least one hole in the tubing using the punch tool.

In this way, a tool such as an anchor tool in the form of a packer or bridge plug can be run in and set on the same tool string which carries in the punch tool. This provides a single trip into the well and gives a datum point to locate the exact relative position of the punched holes.

The method may include the step of detaching the TPST from the reference tool and moving the TPST relative to the reference tool, between steps (c) and (d). In this way, any desired separation between the reference tool and the punched holes can be achieved.

Preferably, the actuation means is pre-programmed at surface to initiate the trigger and sequencing to set the reference tool and punch the holes. By pre-programming the actuation means, control to the surface of the well is not required and the TPST can operate autonomously. Alternatively, the actuation means may be operated via an e-line if used.

Preferably the actuation means initiates the triggering when a specific set of downhole criteria is fulfilled. The downhole criteria may comprise variations in the group comprising downhole pressure; line tension, time duration in the well and the like. Preferably an electronic signal is sent from the actuation means to a power module to trigger the power module.

Preferably, the step of triggering a power delivery module comprises creating high pressure gas via a pyrotechnic charge and directing the gas formed on detonation onto one side of a piston, and via the piston, compressing hydraulic fluid to power the respective tool.

Preferably the step of setting the reference tool comprises using the compressed hydraulic fluid from the power delivery model to provide a compressive force to set the tool. Setting tools using a compressive force for setting packers, bridge plugs and the like are known in the industry.

Preferably the actuation means, senses that the reference tool is set and then sends an electronic signal to trigger the power delivery module to operate the punch tool. The step of sensing that the reference tool is set may be by applying an overpull on the TPST. Alternatively, the step of sensing the reference tool is set may be by sensing pressure in the tubing.

Optionally, the step of sensing the reference tool is set may be by using a time delay following triggering of the power delivery module. Alternatively the setting tool may detach from the reference tool and the triggering of the power delivery module to operate the punch tool may be programmed by other well or time conditions.

Preferably the step of punching a hole comprises using the compressed hydraulic fluid from the power delivery module to provide a compressive force to the boost piston of the punch tool.

Preferably the step of punching at least one hole in the tubing comprises punching two holes approximately 180 degrees apart.

Preferably, excess pressure generated on punching the holes is vented from the punch tool and the punch pistons are retracted as the TPST is retrieved from the well bore.

Advantageously, if the stem sticks in the tubing, the method may include the step of pulling on the tool string to shear the stem and leave a portion of the stem within the tubing wall. More preferably the portion of stem left in the tubing includes an aperture to allow for communication through the tubing.

Advantageously also, if the punch tool becomes stuck, the method may include the step of jarring the TPST to cause a mechanical release to operate in the punch tool to remove parts of the TPST above the punched holes. The method may then further include the step of using a fishing tool to retrieve the remaining parts of the punch tool and the setting tool.

The method may further include the step of running in a tool to locate at the reference tool and use the communication paths now created through the tubing to operate.

The method may also include the steps of:

(e) unlatching the setting tool from an anchor tool;

(f) retrieving the TP ST;

(g) running a gas lift straddle and latching it to the anchor tool;

(h) setting the packing elements on the straddle; and (i) commencing gas injection through the punched holes.

By providing a reference point in the form of the anchor adjacent to the punched hole, advantageously, a relatively short straddle can be installed. The shortened straddle removes the risk in breaking the wireline and ensures it may be used on any rig area. This is all achieved without requiring any additional runs into the well.

Preferably the step of setting the anchor comprises actuating slips in the anchor to bite into the tubing. More preferably the slips are set to be actuated at a fixed time interval after the TPST has reached a predetermined depth in the well.

Advantageously the method includes the step of taking a first overpull to ensure the anchor is set and using the overpull to actuate the punch tool.

Advantageously also, the method includes the step of taking a second overpull on the straddle to ensure the straddle has latched to the anchor.

Preferably the method includes the step of disconnecting a setting tool from the straddle when the straddle is latched to the anchor.

Advantageously the step of disconnecting can be controlled from the second overpull. The step of disconnecting may be timed to occur if a second overpull of a fixed pressure is applied for fixed time duration. Optionally the step of disconnecting may occur if a second overpull is repeated a given number of times in a fixed time interval. Alternatively, the step of disconnecting may occur at a fixed time interval from the time the running tool is below a predetermined depth of the well.

Advantageously the method may include the additional step of retrieving a gas head of the straddle. Preferably the method includes the step of redeploying the gas head to the straddle.

BRIEF DESCRIPTION OF THE FIGURES

Embodiments of the present invention will now be described, by way of example only, with reference to accompanying drawings of which.

DETAILED DESCRIPTION OF THE PREFERRED EMBODIMENTS

Figure 1:
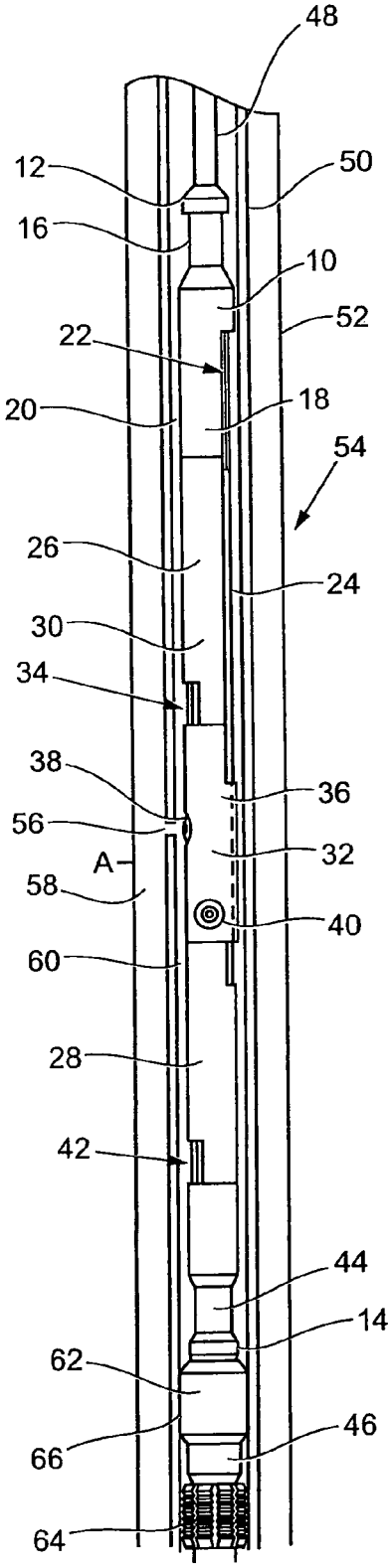
FIG. 1 is a schematic illustration of a TPST according to an embodiment of the present invention, following setting of a reference tool and punching holes in a tubing string.

Reference is initially made to FIG. 1 of the drawings which illustrates a tubing punch and setting tool (TPST), generally indicated by reference numeral 10, in accordance with an embodiment of the present invention. TPST has an upper end 12 and a lower end 14. We will generally refer to these as upper and lower, but it will be appreciated that when the TPST is located in a deviated wellbore, upper will refer to downstream i.e. closer to the well surface and lower will refer to upstream i.e. deeper in the well.

At the upper end 12 there is arranged a wireline connector 16 as is known in the art. The connector 16 may also be any other non-rigid connector such as an e-line or coiled tubing. Arranged below the wireline connector, in a sequential order, is an actuation sensor 18; a second power delivery module 26; a punch tool 32; a first power delivery module 28 and a setting tool 44.

Adjacent to the wireline connector 16 is the actuation sensor 18. The actuation sensor 18 is a module used to trigger and sequence operation of the TPST 10. The actuation sensor comprises a cylindrical body 20 which houses a processor and sensory equipment. The processor is preprogrammed to send out electrical signals on one of two actuation lines 22, 24, when predetermined conditions are met. These conditions are selected by the user at surface and are programmed into the processor. Such criteria may be that a downhole pressure value has been reached, a time has elapsed since a previous event or a tension value has been reached on the wireline. Sensors within the actuation sensor 18 measure the variables being monitored. When the criteria are met an electrical signal is sent down one of the actuation lines 22, 24 which connect the actuation sensor 18 to the first and second power delivery modules 26, 28. A further wireline connection is made between the parts, shown at 34 and 42.

Located adjacent to the actuation sensor 18 is the second power delivery module 26. This module has a similar cylindrical body 30 and stores the energy that will be used to deliver hydraulic pressure to the punch tool 32. Inside the module 26 is a pyrotechnic charge with an electronic igniter. Such an arrangement is typical of a power delivery module but it may also take the form of a differential atmospheric chamber or mechanical ball screw mechanism. The electronic signal in the actuation line 22 ignites the igniter which in turn detonates the charge. The detonation is entirely contained within the body 30 producing a high pressure gas. The gas acts against one side of a separator piston, the opposite side of which is exposed to hydraulic fluid, thus transferring energy from the pyrotechnics into hydraulic pressure and subsequently into hydraulic power transmission.

The pressurised hydraulic fluid operates the punch tool 32 located below the second power delivery module 26. The punch tool 32 may be of any design operated from a compressed fluid source. Preferably, the punch tool 32 is as described in detail hereinafter with reference to FIG. 2(*b*). The punch tool 32 primarily has a cylindrical body 36, through which are located punch assemblies. Though not illustrated as such, the assemblies 38, 40 are used to punch two holes through the wall of the production tubing at 180 degrees to each other.

Below the punch tool 32 is located the first power delivery module 28. This first power delivery module is substantially the same as the second power delivery module 26, described above, excepting that the hydraulic power transmission is now used for a setting tool 44, located adjacent to the power delivery module 28, at the lower end 14 of the TPST 10.

The setting tool 44 at the lower end 14, is a standard setting tool as known in the industry. It can be used to set a tool such as an anchor by compressive force, the compressive force being used to set the anchors slips and seal element to the tubing against which it is set.

In use, the TPST 10 is assembled at surface with the actuation sensor 18 programmed to activate each of the power delivery modules 26, 28 at desired criteria. Variables are set as a trigger for setting and punch initiation as described above. A packer 46 is attached to the setting tool 44 and the tool 10 is suspended from a wireline 48 and run into a tubing string. In this example, see FIG. 1, the tubing string is a production tubing 50 located within a casing 52 of a well bore 54.

The tool 10 is run to a depth, generally marked at 'A', where it is required to punch holes 56, through the production tubing 50 in order to provide communication between the casing annulus 58 and the bore 60 of the production tubing 50. The depth is calculated via the amount of wireline run into the well bore 54. At depth, the actuation sensor 18 senses one of the variables, for example, the time lapsed since entering the well bore 54, and an electronic signal is sent down the actuation line 24 to trigger the first power delivery module 28. The module 28 will detonate sending compressed hydraulic fluid to the setting tool 44. The setting tool 44 then sets the packer 46, by expanding a sealing element 62 and engaging slips 64 against the inner wall 66 of the production tubing 50.

An overpull is taken against the packer 46 to ensure it is set. This overpull is sensed as a change in line tension at the actuation sensor 18. This is the criteria set for triggering the second power delivery module 26. An electronic signal is therefore sent down the actuation line 22, to ignite the charge in the second power delivery module 26. Thus with the packer 44 set as a reference point in the well and the TPST still attached to the packer, compressed hydraulic fluid now operates the punch tool 32. Holes 56 are punched through the tubing 50. The casing 52 is not affected by the action of the punch tool 32.

Following the punching of the holes, the hydraulic pressure is vented and the punch assemblies 38,40 retracted, as will described hereinafter. By upward jarring on the TPST 10, the setting tool 44 will release from the packer 46 and the TPST can be removed from the well bore 54.

The packer 46 now acts as a reference point in the well bore which is spaced at a known distance from the punched holes 56. This has been achieved on a single trip into the well bore 54 running on a wireline.

Figure 2A:
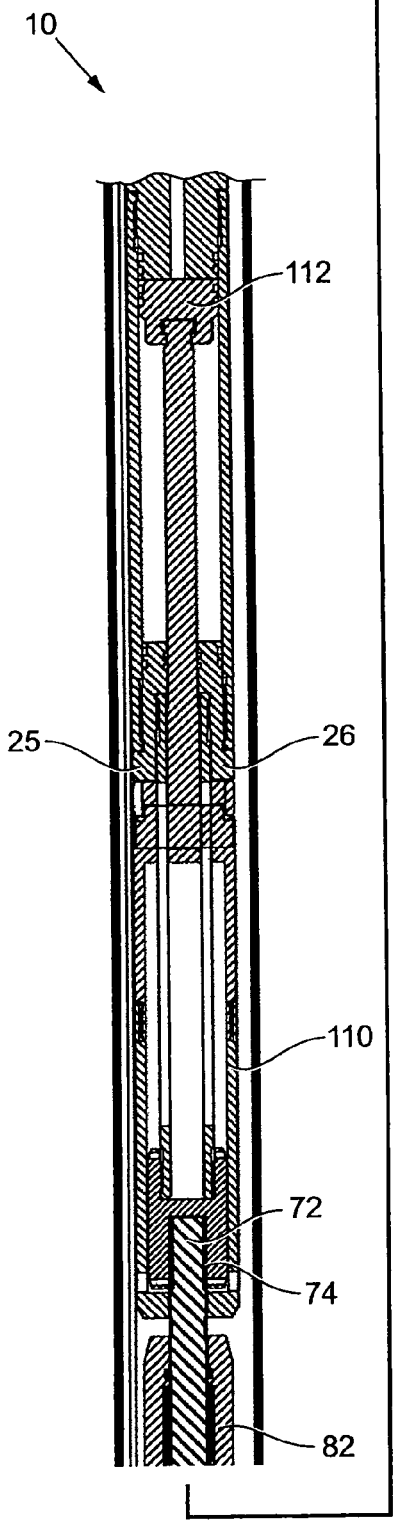
FIGS. 2(*a*) and 2(*b*) are a cross-sectional view through an upper portion of the TPST illustrating the punch tool in a run in configuration.
Figure 2B:
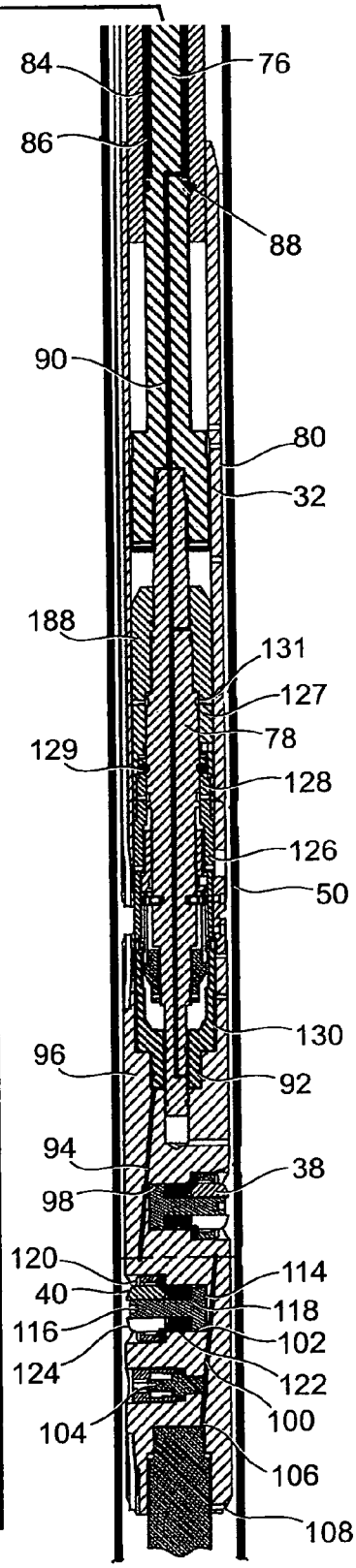
Figure 3A:
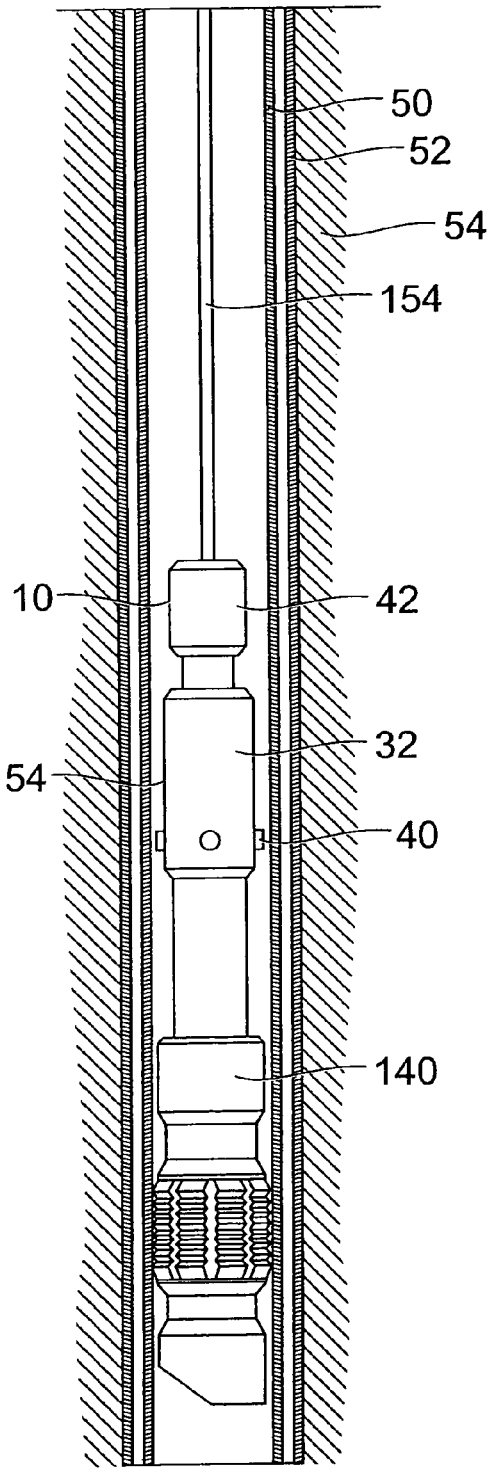
FIGS. 3(*a*) to 3(*d*) are illustrations of a gas lift straddle being installed in a tubular according to progressive steps in a method according to an embodiment of the present invention.
Figure 3B:
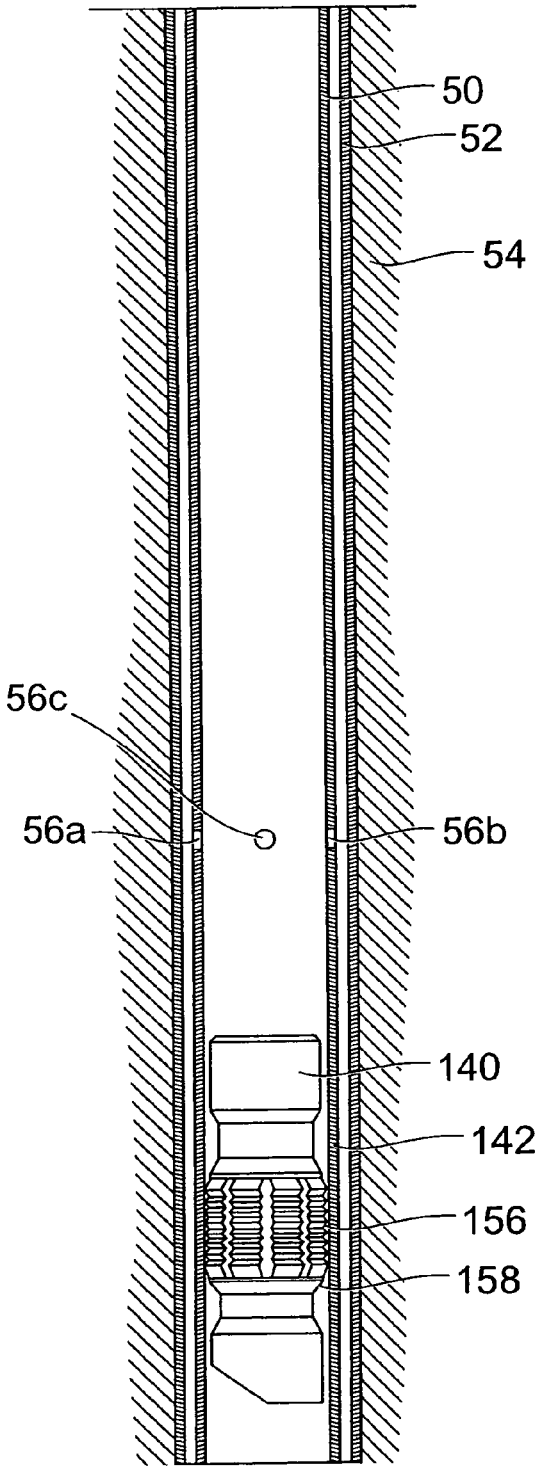
Figure 3C:
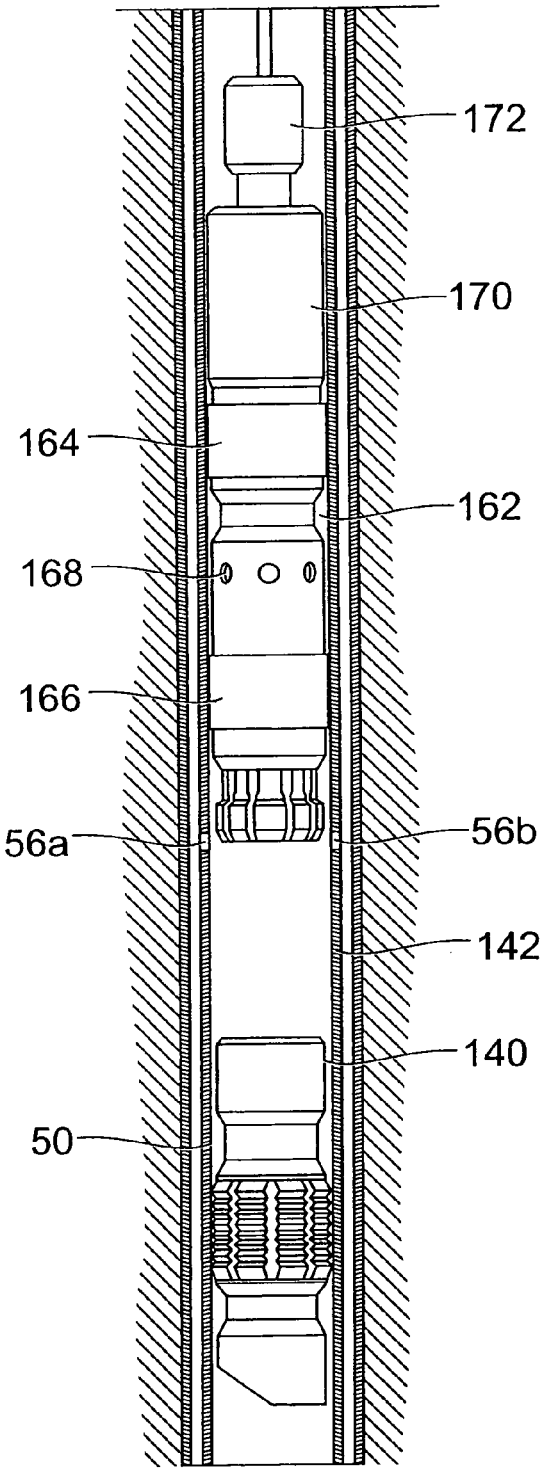
Figure 3D:
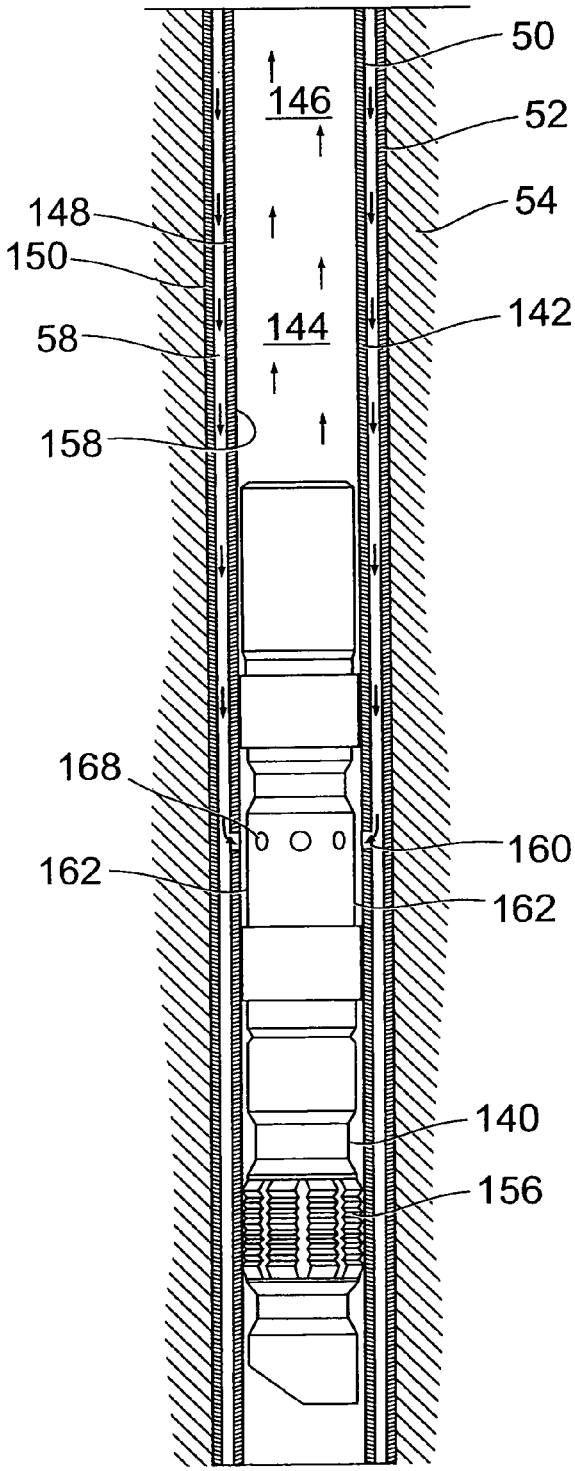

Reference is now made to the punch tool 32 and to the operation thereof. FIGS. 2(*a*) and 2(*b*) illustrate a portion of the TPST 10. Illustrated is a lower portion of the second power delivery module 26 and the punch tool 32. The parts 26, 32 are shown within the production tubing 50 to aid interpretation.

At an upper end 72 of the punch tool 32 is a connector 74 used to fasten the punch tool 32 to the power delivery module 26. Connector 74 terminates a stepped element 76 arranged centrally through the TPST 10 connecting to a tubular element 78. Located around the stepped element 76 and the tubular element 78 is a sleeve 80. Between the stepped element 76 and the sleeve 80 is a boost piston 82 which slides over the stepped element 76. A chamber 84 is created between the piston 82 and the element 76. The chamber 84 contains hydraulic fluid 86.

An orifice 88 in the stepped element 76 provides a hydraulic fluid pathway leading to an inner bore 90 in the tool 32 which extends through a majority of the tubular element 78, and is similarly diverted out through an orifice 92 at its base. The hydraulic fluid pathway is then routed through an off-axis bore 94 in a bottom sub 96 where the punch assemblies 38, 40 are located. The off-axis bore 94 has an exit 98 to the first punch assembly 38 and then travels transversely across the central axis of the sub 96 to an oppositely arranged off-axis bore 100 which has an exit 102 to the second punch assembly 40, a vent 104 and an inlet 106. The inlet 106 is the point for introducing hydraulic fluid into the punch tool 32 and is thus sealed in operation by a plug 108 which may be a connector to the first power delivery module 28 located below.

Thus movement of the boost piston 82 compresses the hydraulic fluid 86 in the chamber 84 and the compressed fluid passes through the bores 94 and 100 to operate the punch assemblies 38, 40. The boost piston 82 is moved under force from an outer sleeve 110 of the power delivery module 26. The force is created by the detonation within the power delivery module 26 with the compressed gas acting on a separator piston 112 which is directly connected to the outer sleeve 110 at a cross-over 25. On movement of the sleeve 110 downwards, the stepped element 76 is held against movement via the connector 74. In this way, movement of the sleeve 110 shifts the boost piston 82 relative to the stepped element 76 and consequently the chamber 84 is reduced in size to compress the hydraulic fluid.

Now considering the punch assemblies 38, 40. These are identical and are located in the sub 96. Each assembly 38, 40 comprises a recess 150 in which is located a piston 116 with a stem 120 and a base 118. A set of disc springs 122, and a punch cap 124 arranged on the stem. The assemblies 38, 40 are arranged side by side in the sub 96 to allow the diameter of the sub 96 to remain small enough to fit within production tubing 50 while providing a maximum distance for the piston 116 to travel to punch the production tubing.

When the charge in the module 26 has been ignited and the detonation has just occurred, the separator piston 112 and the outer sleeve 110 are forced downwards acting on the boost piston 82 and thereby decreasing the size of chamber 84. This compresses the hydraulic fluid 86 through the pathway with the result that fluid is injected through the exits 98, 102 into the recesses of the piston assemblies 38, 40.

The injection of fluid into each recess 114, pushes against the base of the piston 116, and the cap 124, springs 122 and stem 120 will move outwardly. The stem 120 will be sitting proud of the cap 124 and will contact the wall of the production tubing 50. As the stem 120 is circular it will punch a circular aperture through the tubing 50 to create a hole 56. A slug of tubing material will fall away into the annulus 58.

When the separator piston 112 has moved so that the chamber 84 is closed and holes 56 are punched in the tubing 50, the excess hydraulic pressure now found in the flow path will be expelled through the vent 104. This release of hydraulic pressure will allow piston 116 to move the back into the recess 114, so that the assemblies 38, 40 lie clear of the tubing wall 50 when upward jarring of the TPST 10 is performed to allow the setting tool 44 to separate from the packer 46 or other anchor, and the TSPT to be pulled out of the well bore to the surface.

In an alternative embodiment, the stem has at its end a section with a fixed size aperture axially therethrough. The section is created by machining a weak point in the form of a recessed groove around the top of the stem. In case the stem 120 fails to retract fully from the production tubing, the weakened end of the stem will break when the upward jarring action takes place. The portion left in the tubing will have an aperture and thus fluids can circulate or hydraulic fluid can vent through this hole.

For the situation in which the punch tool 32 becomes stuck in the well bore, the TPST 10 can be equipped with an emergency release mechanism, generally indicated by reference numeral 126. Referring to FIG. 2(*b*), the release mechanism 126 is arranged around the tubular element 78 and comprises a collet 128 and a series of locking keys 129 which are held in place by an interlock sleeve 127. When pressurised fluid acts to operate the punch tool 32, sleeve 127 is moved via a shear pin 131. This movement uncovers the keys 129. If the punching of the holes is successful and the TPST 10 is pulled from the well bore, the collet 128 is held closed and lifting of the tool 10 to the surface can be achieved. If, however, the TPST 10 sticks for any reason and cannot be removed, a user will create a downward jarring action on the TPST 10. This downward jarring action causes the now exposed collet 128 to be desupported, releasing the keys 129. An upper end of the TPST can then be removed leaving the sub 96. Advantageously, the upper end of the sub 96, terminates in an internal fishing neck 130. Thus while a lower section of the TPST 10 is left in-situ, means are provided in the fishing neck 130 to assist in its retrieval. Additionally as the hydraulic fluid pathway is now open via the break in the connection at the end of the bore 92 and the off-axis bore 94, all the hydraulic pressure is positively vented.

An embodiment of the present invention will now be described for the installation of a retrofit gas lift straddle. Gas lift straddles are used when an artificial lift system is required in a well where a gas lift was either never in the original well design or the side pocket mandrels for gas lift are located in an undesirable position. Reference is now made to FIG. 3(*a*) of the drawings which illustrates the TPST 10 of FIG. 2 latched to an anchor tool 140 being run in a well requiring a gas lift straddle. The well bore 54 is lined with casing 52. Located within the casing 52 is the completion string 50 being a tubing 142 having a through bore 144 in which the oil 146 can travel. Between the surface wall 148 of the tubing 142 and the inner surface 150 of the casing 52 is an annulus 58. The annulus 58 provides a passageway for gas 152 to be injected into the oil 146 as long as communication can be established through the tubing 142 for the passage of the gas 152.

Prior to running a gas lift straddle, a wireline Casing Collar Location (CCL) with a combined drift run is typically undertaken to establish the location of the collars, control line clamps etc in the vicinity of the intended location of the ports in the tubing 142. This is as known in the art and is used to verify that there are no obstructions prior to running the anchor tool 140.

The TPST 10 and anchor tool 140 are connected to 0.92" or 0.125 slickline 154, so that the entire assembly can be run to the desired depth in the completion string 50. The desired depth is the position in the well bore 54 at which the gas injection is required.

On reaching the desired position the anchor tool 140 is set. This is achieved via the setting tool in the TPST 10, for example, the setting tool 44 will switch on when the hydrostatic pressure or depth is at 2,815 psi or 6,500 ft TVD, respectively. Once the setting tool 42 has been lowered below the desired depth for a period of time e.g. 30 minutes, the setting tool 42 will fire and set the anchor tool 140. In this regard, the slips 156 are pushed into the inner surface 158 of the tubing 142. The anchor tool 140 is thus anchored to the completion string 50 to provide a fixed reference point in the well bore 54. It will be appreciated that if the anchor tool 140 is raised above the desired depth, the timer on the setting tool can be re-set so that the tool 140 can be prevented from being anchored if it is decided not to proceed once the slickline 154 is run in the well bore 54.

With the slips 156 engaged, the punch tool 32 is operated by applying an overpull on the assembly. A suggested overpull load required and time the overpull load should be applied to initiate the punch tool could be 1,000 lbs for 10 mins. Thus once the anchor tool 140 has been set we apply the pre-set overpull (1,000 lbs) on the anchor 140, initially, to verify that it has set and is holding load. The overpull is then applied for the pre-determined time (10 mins). This will actuate the puncher tool 32 as described with reference to FIGS. 2(*a*) and 2(*b*).

If possible slight annulus 58 pressure applied before the punch would give an indication that the punch has performed satisfactorily. Once the tubing 142 has been punched, upward jarring on the punch tool 32 will release the latch from the anchor tool 140 and allow the TPST 10 to be retrieved to the surface. The shear load to achieve release of the latch is adjustable but nominally set at a 7,500 lb load across six shear screws. The arrangement in the well bore 54 is now as illustrated in FIG. 3(*b*) showing the anchor tool 140 remaining at a fixed reference point in the well bore 54 and the ports 160*a,b* made through the tubing 142 of the completion string 50.

The gas lift straddle 162 is run on a slickline 154 as is illustrated in FIG. 3(*c*). The straddle 162 comprises a latch at the base which can be stabbed into the anchor tool 140; first 164 and second 166 packer elements being spaced apart over apertures 168 being gas inlet ports; and a gas head 170 located at the upper end which houses the check valve. A setting tool 172 is located between the straddle 162 and the slickline 154. The straddle 162 is as known in the art except in that the distance between the packer elements 164, 166 is reduced by approximately an order of magnitude. For example, a typical 20 foot straddle is reduced in length to approximately 8 to 10 feet. More importantly, the distance from the latching end of the punch tool to a punch 40 in the punch tool 32 is approximately equal to the distance between the latching end (nearest the anchor tool 140) of the straddle 162 to a point midway between the packer elements 164, 166 of the straddle 162. The midway point can be at the location of the apertures 168.

The straddle 162 is run to depth and stabbed into the top of the anchor tool 140. An over pull of 1,000 lbs, for example, should be applied to check the straddle 162 is in the correct location and this will in turn activate the setting tool 172 as described with reference to the punch tool 32 previously. During the over pull, as the setting tool 172 strokes out to apply load to the straddle 162, a support sleeve is sheared out which in turn slides under the collet linking the straddle 162 to the anchor tool 140. This locks the straddle 162 to the anchor tool 140.

As the load from the setting tool 172 increases the straddle packing elements 164, 166 are set. Thus a seal is created between the tubing 142 and the straddle 162 on either side of the punched holes 56.

At a predetermined load a shear ring parts and the setting tool 172 is released from the straddle 162. The setting tool is then pulled from the well.

With the straddle 162, now arranged in the well bore 54 as illustrated in FIG. 3(*d*), a pressure test can be applied to the annulus 58 to verify that the packing elements 164, 166 have set properly. At a pre-determined test value (say 500 psi) a test mechanism in the straddle 162 shears out allowing communication from the annulus 58 to tubing 142 via the ports 56, apertures 168 and the check valves in the gas head 170.

By injecting gas 152 down the annulus 58 from the surface, the oil 146 is mixed with the gas 152 in the gas head 170 assisting in providing the necessary lift to the oil 146 to raise it to the surface. This is illustrated by the arrows in FIG. 3(*d*).

If the check valve needs to be replaced i.e. for repair or a change in injection rate or volume is required, the gas head 170 can be removed without having to release the straddle 162. The gas head 170 is retrieved by running in with a running/pulling tool and latching into the top of the gas head 170. Upward jarring will shear out the shear screws in the latch locking the gas head 170 to the straddle 162. Once the gas head 170 is re-dressed it can be re-run by latching it to the running/pulling tool. The gas head 170 is then run to depth and stabbed into the top of the straddle 162. Further downward jarring will shear out the running/pulling tool, allowing it to be pulled back to the surface on the slickline 154.

Additionally, both the straddle 162 and the anchor tool 140 can also be retrieved if full access to the through bore 144 is required. Initially the straddle 162, in combination with the gas head, is removed. For this option a pulling tool is used in conjunction with a No-Go. These are as known in the art. This is located into the top of the gas head 170. An over pull can be taken to ensure it is engaged properly. Downward jarring will then slide the No-Go into the release sleeve located at the bottom of the straddle 162. This sleeve is jarred down to de-support the collet locking the straddle to the anchor tool 140. Once this sleeve has been shifted, upward jarring will release the gas head 170 and straddle 162 from the anchor tool 140.

With the straddle 162 removed a pulling tool is run inside of the anchor tool 140. Once the pulling tool has engaged the profile in the release sleeve, upward jarring will shift this sleeve de-supporting a set of dogs. With the dogs de-supported this allows the upward jarring to stroke out the slips. A C-ring pops into a groove holding the release sleeve in the up position and therefore preventing the slips from being re-supported on the way out of the hole. This technique for releasing the anchor tool 140 is as known in the art.

The principal advantage of the present invention is that it provides a tubing punch and setting tool for running and setting a tool in a tubing string and for punching at least one hole in the tubing string at a known location above the tool on a single trip. The hole positions are known relative to the set tool with a high accuracy.

A further advantage of at least one embodiment of the present invention is that it provides a tubing punch and setting tool which can be preprogrammed so that no electronic or telemetry signaling is required from surface to operate. By preprogramming the tool can be set to initiate at any desired parameter or combination of parameters.

A still further advantage of at least one embodiment of the present invention is that it provides a tubing punch and setting tool which vents all excess pressure after the setting and punching functions are complete.

A further advantage of at least one embodiment of the present invention is that by creating a reference point in the well bore, a gas lift straddle can be fitted where the straddle can be made much shorter as the formed hole position is known very accurately. Further the gas head, or the gas head and straddle together, can be pulled for re-dress. The anchor remains in situ maintaining the reference distance between the anchor tool and the punched hole. This makes locating the hole easier for the re-running of the straddle and gas head. Yet further, any impact loads which occur when running in or pulling out of the hole are routed through to the setting tool 172, therefore preventing premature setting of the anchor tool 140 during run in/out of the hole.

It will be apparent to those skilled in the art that various modifications may be made to the invention described herein without departing from the scope thereof. For example, the power delivery modules and the punch tool could be arranged on the TPST in any order. Two holes are illustrated and described as being punched in the tubing but any number of punch assemblies may be used. Additionally any punch tool and setting tool can be used, though those operated by compressed fluid are preferred. While punching production tubing in casing is described, the TPST can be used within any walled tubing string with or without external casing or other tubular present.

What is claimed is:

1. A tubing punch and setting tool (TPST) for running and setting a reference tool in a tubing string in a well bore and for punching at least one hole in the tubing string on a single trip in the well bore, the TPST comprising: a substantially cylindrical body having a first end adapted for connection to conveyancing means; a setting tool with means to connect to the reference tool at a second end; a punch tool comprising a substantially cylindrical body including at least two punch assemblies arranged perpendicularly to a central axis of the body, a hydraulic fluid chamber including a boost piston to compress the fluid and a fluid pathway, from the chamber, to deliver the compressed fluid to the punch assemblies and thereby operate the punch assemblies; at least two power delivery module; and, an actuation means located between the ends; wherein the actuation means adapted to trigger first power delivery module to power the setting tool to set the reference tool against the tubing and trigger second power delivery module to power the punch tool to punch at least one hole in the tubing.

2. The TPST according to claim 1 wherein the conveyancing means is selected from a group comprising: wireline, e-line and coiled tubing.

3. The TPST according to claim 1 wherein the first power delivery module is located adjacent the setting tool and a second power delivery module is located adjacent the punch tool.

4. The TPST according to claim 1 wherein the boost piston is powered from the second power delivery module.

5. The TPST according to claim 1 wherein the punch tool includes a vent to allow for the exit of hydraulic fluid in the flow path from the tool at a predetermined pressure.

6. The TPST according to claim 1 wherein the punch tool includes emergency release means in the event that the punch tool becomes stuck, the means comprising a weakened portion at the end of the pistons which shears off leaving a portion of the piston in the tubing with an aperture therethrough.

7. The TPST according to claim 1 wherein the punch tool includes emergency release means in the event that the punch tool becomes stuck, the means comprising a mechanical release to separate the TPST at a location above the punch assemblies and allow the conveyancing means carrying the TPST to be pulled out of the hole.

8. The TPST according to claim 1 wherein the reference tool is an anchor.

9. The TPST according to claim 8 wherein the anchor is adapted to latch to the setting tool and a gas lift straddle wherein a first length from a latching end of the setting tool to a punch of the punch tool is approximately equal to a second length from a latching end of the straddle to a point midway between packer elements of the straddle.

10. The TPST according to claim 9 wherein the gas lift straddle comprises a tubular body having a through bore, first and second packer elements at first and second ends of the body, at least one port located through the body between the packer elements, and a gas head located on the body, the gas head having an inlet through which fluid from the port enters a check valve to ensure the fluid can only travel from the port to the bore.

11. A single trip well intervention method, comprising the steps;

(a) locating a reference tool on a setting tool of a TPST, the TPST comprising: a substantially cylindrical body having a first end adapted for connection to conveyancing means; a setting tool with means to connect to the reference tool at a second end; a punch tool comprising a substantially cylindrical body including at least two punch assemblies arranged perpendicularly to a central axis of the body, a hydraulic fluid chamber including a boost piston to compress the fluid and fluid pathway, from the chamber, to deliver the compressed fluid to the punch assemblies and thereby operate the punch assemblies; at least two power delivery module; and, an actuation means located between the ends; wherein the actuation means triggers the power delivery module to power the setting tool to set the reference tool against the tubing and triggers the power delivery module to power the punch tool to punch at least one hole in the tubing;

(b) running the TPST into a tubing string until the punch tool is at a desired depth to locate a punched hole through the tubing;

(c) triggering first power delivery module to set the reference tool against a wall of the tubing using the setting tool; and (d) triggering second power delivery module to punch at least one hole in the tubing using the punch tool.

12. The single trip well intervention method according to claim 11, wherein the method includes the step of detaching the TPST from the reference tool and moving the TPST relative to the reference tool, between steps (c) and (d).

13. The single trip well intervention method according to claim 11 wherein the triggering is controlled via actuation means which is pre-programmed at surface to initiate the trigger and sequencing to set the reference tool and punch the holes.

14. The single trip well intervention method according to claim 11 wherein the triggering is controlled via actuation means which initiates the triggering when a specific set of downhole criteria is fulfilled.

15. The single trip well intervention method according to claim 11 wherein the step of triggering a power delivery module comprises creating high pressure gas via a pyrotechnic charge and directing the gas formed on detonation onto one side of a piston, and via the piston, compressing hydraulic fluid to power the reference tool.

16. The single trip well intervention method according to claim 13 wherein the actuation means, senses that the reference tool is set and then sends an electronic signal to trigger the power delivery module to operate the punch tool.

17. The single trip well intervention method according to claim 11 wherein the method includes the step of running in a tool to locate at the reference tool and using the communication paths now created through the tubing to operate.

18. A single trip well intervention method, comprising the steps;

(a) locating a reference tool on a setting tool of a TPST, the TPST comprising: a substantially cylindrical body having a first end adapted for connection to conveyancing means; a setting tool with means to connect to the reference tool at a second end; a punch tool comprising a substantially cylindrical body including at least two punch assemblies arranged perpendicularly to a central axis of the body, a hydraulic fluid chamber including a boost piston to compress the fluid and a fluid pathway, from the chamber, to deliver the compressed fluid to the punch assemblies and thereby operate the punch assemblies; at least two power delivery module; and, an actuation means located between the ends; wherein the actuation means triggers the power delivery module to power the setting tool to set the reference tool against the tubing and triggers the power delivery module to power the punch tool to punch at least one hale in the tubing;

(b) running the TPST into a tubing string until the punch tool is at a desired depth to locate a punched hole through the tubing;

(c) triggering first power delivery module to set the reference tool against a wall of the tubing using the setting tool;

(d) triggering second power delivery module to punch at least one hole in the tubing using the punch tool;

(e) unlatching the setting tool from an anchor tool;

(f) retrieving the TPST;

(g) running a gas lift straddle and latching it to the anchor tool;

(h) setting the packing elements on the straddle; and (i) commencing gas injection through the punched holes.

19. The single trip well intervention method according to claim 18 wherein the method includes the step of taking a first overpull to ensure the anchor is set and using the overpull to actuate the punch tool.

20. The single trip well intervention method according to claim 18 wherein the method includes the step of disconnecting the setting tool from the straddle when the straddle is latched to the anchor.

* * * * *